US011008734B2

(12) United States Patent
Nakajima

(10) Patent No.: US 11,008,734 B2
(45) Date of Patent: May 18, 2021

(54) HYDRAULIC CONTROL CIRCUIT FOR CONSTRUCTION MACHINE

(71) Applicant: Caterpillar SARL, Geneva (CH)

(72) Inventor: Hideki Nakajima, Akashi (JP)

(73) Assignee: Caterpillar SARL, Geneva (CH)

( * ) Notice: Subject to any disclaimer, the term of this patent is extended or adjusted under 35 U.S.C. 154(b) by 0 days.

(21) Appl. No.: 16/765,281

(22) PCT Filed: Nov. 14, 2018

(86) PCT No.: PCT/EP2018/025291

§ 371 (c)(1),
(2) Date: May 19, 2020

(87) PCT Pub. No.: WO2019/101362

PCT Pub. Date: May 31, 2019

(65) Prior Publication Data

US 2020/0308808 A1 Oct. 1, 2020

(30) Foreign Application Priority Data

Nov. 22, 2017 (JP) ..... JP2017-224603

(51) Int. Cl.
*E02F 9/22* (2006.01)

(52) U.S. Cl.
CPC ..... *E02F 9/2228* (2013.01)

(58) Field of Classification Search
CPC ..... F15B 21/042; F15B 21/0427; F15B 2211/851; F15B 2211/857;
(Continued)

(56) References Cited

U.S. PATENT DOCUMENTS

2016/0305093 A1* 10/2016 Fukuda ..... E02F 9/2285

FOREIGN PATENT DOCUMENTS

EP 1577563 A2 9/2005
EP 2492494 A2 8/2012
(Continued)

OTHER PUBLICATIONS

The International Search Report related to Application No. PCT/EP2018/025291; dated Apr. 1, 2019.
(Continued)

*Primary Examiner* — F Daniel Lopez
*Assistant Examiner* — Daniel S Collins

(57) ABSTRACT

To provide a hydraulic control circuit for a construction machine capable of shortening a time duration from the start of an engine until the pressure of a pump oil passage reaches a required pressure. A hydraulic control circuit for a construction machine includes a hydraulic pump that is driven by an engine; a hydraulic actuator that is operated by hydraulic oil discharged from the hydraulic pump; a hydraulic pilot type control valve that controls an amount and a direction of supply of the hydraulic oil to the hydraulic actuator from the hydraulic pump; a pump oil passage that connects the hydraulic pump and a pump port of the hydraulic pilot type control valve; a bypass oil passage that branches from the pump oil passage and extends to a hydraulic oil tank; a bypass valve that is disposed in the bypass oil passage and controls an amount of the hydraulic oil returning to the hydraulic oil tank through the bypass oil passage; and a pilot oil passage that branches from the pump oil passage and extends to a pilot port of the hydraulic pilot type control valve; an electromagnetic proportional pressure reducing valve that is disposed in the pilot oil passage and controls a pressure acting on the pilot port; a controller that controls an operation of the bypass valve and the electromagnetic proportional pressure reducing valve; and an operation implement for outputting an operation signal to the controller in response to an operation applied from an operator. The controller sets the opening area A of the bypass valve to a second opening area A1 in a state where an operation signal is not output from the operation implement
(Continued)

after the engine has been started and the pressure of the pump oil passage has reached a required pressure P0, and sets the opening area A of the bypass valve to a second opening area A2 which is smaller than the first opening area A1 during a time duration from the start of the engine until the pressure of the pump oil passage reaches the required pressure P0.

2 Claims, 3 Drawing Sheets

(58) Field of Classification Search
CPC .. F15B 2211/50554; F15B 2211/50536; F15B 2211/327; E02F 9/2228
See application file for complete search history.

(56) References Cited

FOREIGN PATENT DOCUMENTS

| | | | |
|---|---|---|---|
| EP | 2660479 | A1 | 11/2013 |
| JP | 2001263304 | A | 9/2001 |
| JP | 2013127273 | A | 6/2013 |

OTHER PUBLICATIONS

International Search Report for related International Application No. PCT/EP2018/025291; dated Apr. 1, 2019.

* cited by examiner

HYDRAULIC CONTROL CIRCUIT FOR CONSTRUCTION MACHINE

CROSS-REFERENCE TO RELATED APPLICATION

This Application is a 35 USC § 371 US National Stage filing of international Application No. PCT/EP2018/025291 filed on Nov. 14, 2018 which claims priority under the Paris Convention to Japanese Patent Application No. 2017-224603 filed on Nov. 22, 2017.

TECHNICAL FIELD

The present invention relates to a hydraulic control circuit for a construction machine.

BACKGROUND ART

Generally, a hydraulic control circuit for a construction machine such as a hydraulic shovel includes an operation implement for outputting an operation signal in response to an operation applied from an operator, and a hydraulic pilot type control valve that controls a supply amount and a supply direction of hydraulic oil from a hydraulic pump to a hydraulic actuator in response to the operating signal output from the operation implement. In addition, the hydraulic control circuit for the construction machine may be provided with a bypass oil passage that branches from a pump oil passage and extends to a hydraulic oil tank, in order to adjust the pressure of the pump oil passage connecting the hydraulic pump and a pump port of the hydraulic pilot type control valve, and a bypass valve (also referred to as a bleed-off valve) that controls the amount of the hydraulic oil returning to the hydraulic oil tank through the bypass oil passage (See the Patent Document 1, for example). Generally, the bypass valve includes a bypass valve housing, a bypass valve spool movably housed in the bypass valve housing, a bypass valve spring that urges the bypass valve spool to an initial position, and a proportional solenoid that causes the bypass valve spool to move against an urging force of the bypass valve spring. The bypass valve, whose opening area is adjusted by the movement of the bypass valve spool, is configured such that usually its opening area becomes maximal at the initial position of the bypass valve spool, and its opening area gradually decreases as the movement stroke from the initial position of the bypass valve spool increases. When the operation implement is put in neutral with an operation being not applied on the operation implement, the bypass valve spool is positioned at the initial position, so that the opening area of the bypass valve is maximized, and the hydraulic oil discharged from the hydraulic pump passes through the bypass oil passage and returned to the hydraulic oil tank. Accordingly, the pressure of the pump oil passage become small when the operation implement is put in neutral, and thus, energy saving is achieved. On the other hand, because the movement stroke of the bypass valve spool gradually increases as the amount of operation applied to the operation implement increases, the opening area of the bypass valve gradually becomes small, and therefore the amount of the hydraulic oil returning to the hydraulic oil tank through the bypass oil passage decreases. Accordingly, the hydraulic oil discharged from the hydraulic pump is controlled by the hydraulic pilot type control valve and supplied to the hydraulic actuator.

In addition, a bypass valve may be provided in a hydraulic control circuit to which hydraulic oil is supplied from a hydraulic pump common to a pump oil passage and a pilot oil passage connected to a pilot port of a hydraulic pilot type control valve (See the Patent Document 2, for example)

PRIOR ART DOCUMENTS

Patent Documents

[PATENT DOCUMENT 1] Japanese Patent Application Laid-Open No. 2013-127273

[PATENT DOCUMENT 2] Japanese Patent Application Laid-Open No. 2001-263304

SUMMARY OF THE INVENTION

Problems to be Solved by the Invention

However, in a case where a bypass valve is provided in the hydraulic control circuit to which hydraulic oil is supplied from a hydraulic pump common to a pump oil passage and a pilot oil passage, it takes time until the pressure of the pump oil passage reaches a required pressure from the start of the engine, and thus there is a problem of poor operational responsiveness of a hydraulic actuator to the operation applied to the operation implement. More specifically, since the bypass valve spool is positioned at an initial position by an urging force of a bypass valve spring when the engine is started, the opening area of the bypass valve is maximal similarly to the opening area of the bypass valve when the operation implement is put in neutral, and a rotational speed of the engine is low and a pump discharge amount is small immediately after the engine is started. Accordingly, it takes time until the pressure of the pump oil passage reaches the required pressure from the start of the engine. Thus, the operational responsiveness of the hydraulic actuator to the operation applied to the operation implement becomes poor.

An object of the present invention made in view of the above fact is to provide a hydraulic control circuit for a construction machine capable of shortening the time until the pressure of the pump oil passage reaches a required pressure from the start of the engine.

Means for Solving the Problems

In order to solve the above problems, the present invention provides a hydraulic control circuit as described below. That is, a hydraulic control circuit for a construction machine including a hydraulic pump that is driven by an engine; a hydraulic actuator that is operated by hydraulic oil discharged from the hydraulic pump; a hydraulic pilot type control valve that controls an amount and a direction of supply of the hydraulic oil from the hydraulic pump to the hydraulic actuator; a pump oil passage that connects the hydraulic pump and a pump port of the hydraulic pilot type control valve; a bypass oil passage that branches from the pump oil passage and extends to a hydraulic oil tank; a bypass valve that is disposed in the bypass oil passage and controls an amount of the hydraulic oil returning to the hydraulic oil tank through the bypass oil passage; a pilot oil passage that branches from the pump oil passage and extends to a pilot port of the hydraulic pilot type control valve; an electromagnetic proportional pressure reducing valve that is disposed in the pilot oil passage and controls a pressure acting on the pilot port; a controller that controls an operation of the bypass valve and the electromagnetic proportional pressure reducing valve; and an operation implement for outputting an operation signal to the controller in response to an operation applied from an operator. The controller sets the opening area of the bypass valve to a first opening area in a state where an operation signal is not output from the operation implement after the engine has been started and the pressure of the pump oil passage has reached a required pressure, and sets the opening area of the bypass valve to a second opening area which is smaller than the first opening area during a time duration from the start of the engine until the pressure of the pump oil passage reaches the required pressure.

The bypass valve includes a bypass valve housing, a bypass valve spool movably housed in the bypass valve housing, a bypass valve spring that urges the bypass valve spool to an initial position, and a proportional solenoid that causes the bypass valve spool to move against an urging force of the bypass valve spring. Preferably, the opening area of the bypass valve is set at the second opening area when the bypass valve spool is positioned at the initial position, the opening area of the bypass valve is set at 0 when a movement stroke from the initial position of the bypass valve spool reaches a first movement stroke, and the opening area of the bypass valve is set at the first opening area when a movement stroke from the initial position of the bypass valve spool reaches a second movement stroke which is larger than the first movement stroke.

Advantageous Effects of the Invention

According to the hydraulic control circuit provided by the present invention, the controller sets the opening area of the bypass valve at the first opening area in a state where the engine is started and the pressure of the pump oil passage has reached a required pressure and an operation signal is not output from the operation implement, and sets the opening area of the bypass valve at the second opening area smaller than the first opening area during a time duration from the start of the engine until the pressure of the pump oil passage reaches the required pressure. Thus, the time from the start of the engine until the pressure of the pump oil passage reaches the required pressure can be shortened.

DETAILED DESCRIPTION OF THE INVENTION

Hereinbelow, embodiments of a hydraulic control circuit for a construction machine configured in accordance with the present invention will be discussed with reference to the drawings.

Figure 1:
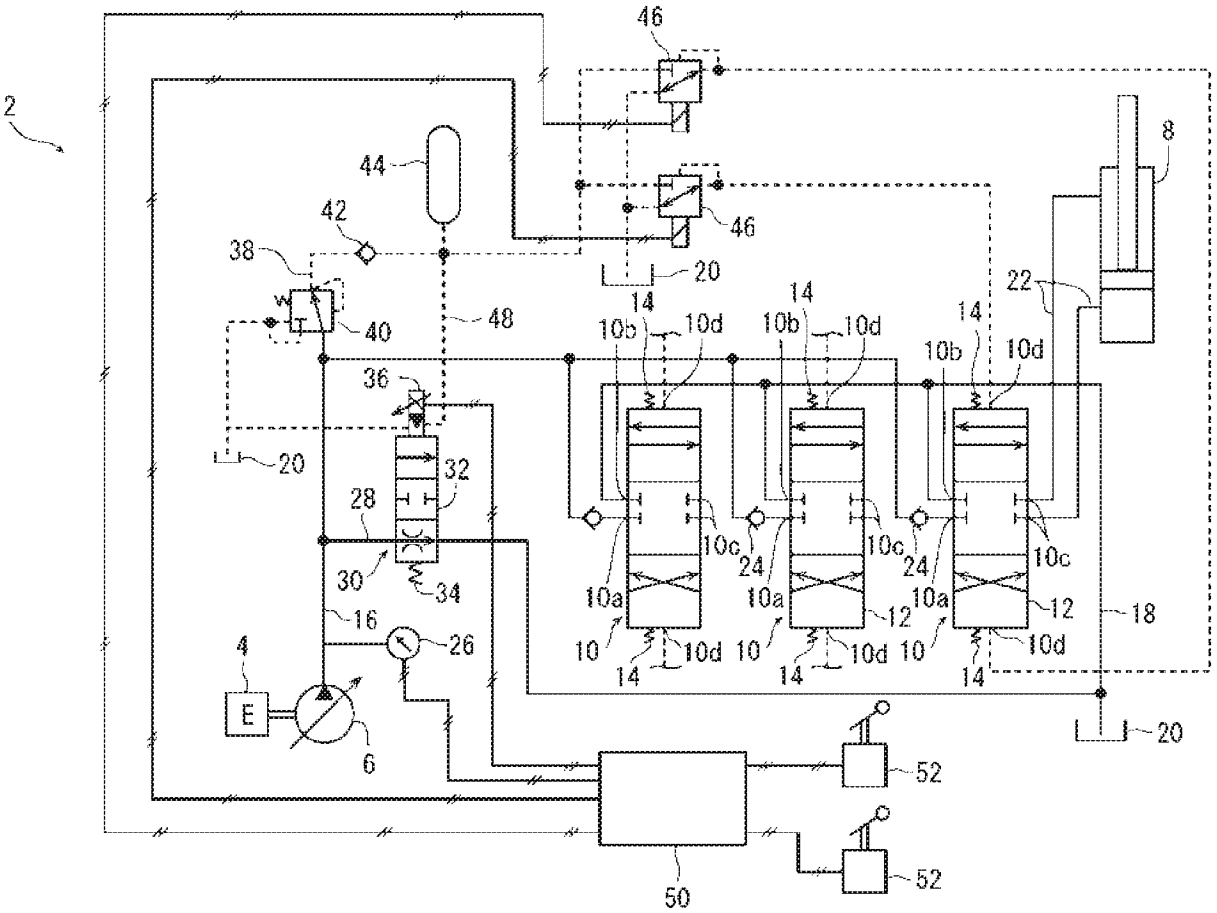
FIG. 1 is a circuit diagram illustrating a hydraulic control circuit for a construction machine configured in accordance with the present invention.

Hydraulic control circuit 2 illustrated in FIG. 1 which is applied to a construction machine such as a hydraulic shovel includes a variable displacement hydraulic pump 6 driven by an engine 4, a hydraulic actuator 8 that is operated by hydraulic oil discharged from the hydraulic pump 6, and a plurality (three in the illustrated embodiment) of hydraulic pilot type control valves 10 that control an amount and a direction of supply of the hydraulic oil to the hydraulic actuator 8 from the hydraulic pump 6. Although only one hydraulic actuator 8 is illustrated in FIG. 1 for the sake of convenience, the hydraulic actuator 8 constituted of a hydraulic cylinder or a hydraulic motor is connected to each of the hydraulic pilot type control valves 10. Each hydraulic pilot type control valve 10 includes a control valve housing (not illustrated), a control valve spool 12 movably housed in the control valve housing, and a pair of control valve springs 14 that urge the control valve spool 12 to an initial position. Within the control valve housing, there are formed a pump port 10*a* connected to the hydraulic pump 6 by a pump oil passage 16, a tank port 10*b* that is connected to a hydraulic oil tank 20 by a tank oil passage 18, a pair of actuator ports 10*c* that are connected to the hydraulic actuator 8 through a pair of actuator oil passages 22, and a pair of pilot ports 10*d* to which the hydraulic oil (pilot oil) for moving the control valve spool 12 is guided. The hydraulic pilot type control valve 10 of the illustrated embodiment is of a closed center type in which mutual communication between the pump port 10*a*, the tank port 10*b* and the pair of actuator ports 10*c* is cut off, when the control valve spool 12 is positioned at a neutral position by the control valve spring 14. When the pressure of the hydraulic oil guided to one of the pair of pilot ports 10*d* becomes larger than the urging force of the control valve spring 14 disposed on the other side of the pair of pilot ports 10*d*, the control valve spool 12 is moved from the neutral position, and the pump port 10*a* and one of the pair of actuator ports 10*c* are in communication with each other and the other of the pair of actuator ports 10*c* and the tank port 10*b* are in communication with each other. Then, the hydraulic oil is supplied from the hydraulic pump 6 to the hydraulic actuator 8 via the pump oil passage 16, the hydraulic pilot type control valve 10 and one of the pair of actuator oil passages 22, and the hydraulic oil is returned from the hydraulic actuator 8 to the hydraulic oil tank 20 via the other of the pair of actuator oil passages 22, the hydraulic pilot type control valve 10 and the tank oil passage 18, so that the hydraulic actuator 8 is operated. As illustrated in FIG. 1 in the illustrated embodiment, the hydraulic pump 6 and each of the pump ports 10*a* are connected in parallel through the pump oil passage 16. A check valve 24 for retaining a load pressure of the hydraulic actuator 8 is disposed in an upstream side part of each of the pump ports 10*a* in the pump oil passage 16. In the pump oil passage 16, a pressure sensor 26 that detects the pressure of the pump oil passage 16 is provided.

As illustrated in FIG. 1, the hydraulic control circuit 2 includes a bypass oil passage 28 that branches from the pump oil passage 16 and extends to the hydraulic oil tank 20, and a bypass valve 30 that is disposed in the bypass oil passage 28 and controls the amount of the hydraulic oil returning to the hydraulic oil tank 20 through the bypass oil passage 28. The bypass valve 30 includes a bypass valve housing (not illustrated), a bypass valve spool 32 movably housed in the bypass valve housing, a bypass valve spring 34 that is disposed on one end side of the bypass valve spool 32 and urges the bypass valve spool 32 to an initial position, and a proportional solenoid 36 that is disposed on the other end side of the bypass valve spool 32 and causes the bypass valve spool 32 to move against the urging force of the bypass valve spring 34. The opening area of the bypass valve 30 is adjusted by the movement of the bypass valve spool 32 and the amount of the hydraulic oil returning to the hydraulic oil tank 20 through the bypass oil passage 28 is controlled, in accordance with the opening area of the bypass valve 30.

Figure 2:
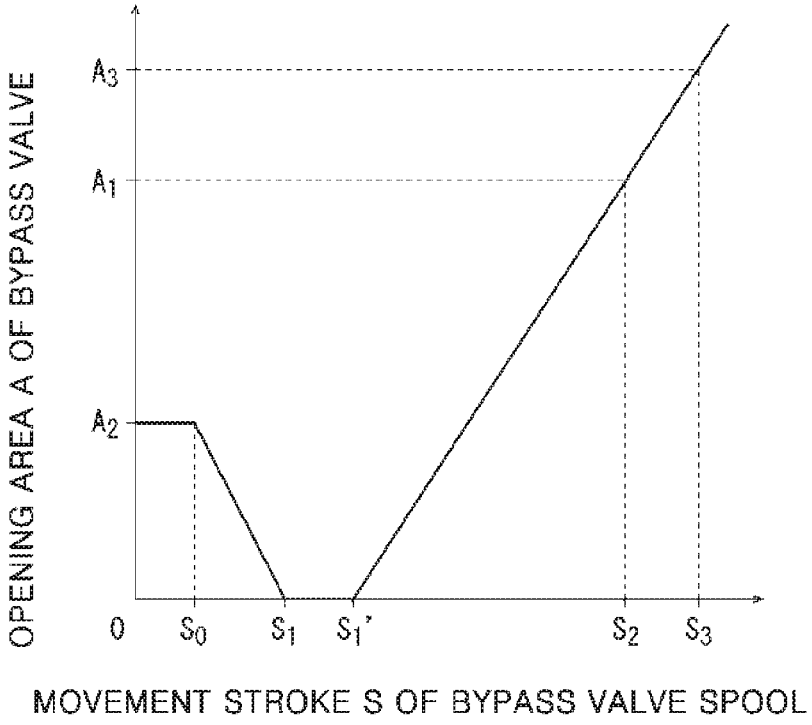
FIG. 2 is a graph showing a relationship between a movement stroke of a spool of a bypass valve and an opening area of the bypass valve illustrated in FIG. 1.

With reference to FIG. 2, the relationship between a movement stroke S (horizontal axis in FIG. 2) from an initial position of the bypass valve spool 32 and an opening area A (vertical axis in FIG. 2) of the bypass valve 30 will be discussed. In a state where no current is applied to the proportional solenoid 36, the bypass valve spool 32 is positioned at the initial position by the bypass valve spring 34. When electric current is applied to the proportional solenoid 36, the proportional solenoid 36 causes the bypass valve spool 32 to move against an urging force of the bypass valve spring 34. As the current applied to the proportional solenoid 36 increases, the movement stroke S from the initial position of the bypass valve spool 32 increases. As illustrated in FIG. 2, preferably, the opening area A of the bypass valve 30 is set at a second opening area A2 when the bypass valve spool 32 is positioned at the initial position (when the movement stroke S is 0); the opening area A of the bypass valve 30 is set at 0 (fully closed) when the movement stroke S from the initial position of the bypass valve spool 32 reaches a first movement stroke S1; and the opening area A of the bypass valve 30 is set at a first opening area A1 (A1>A2) larger than the second opening area A2 when the movement stroke S from the initial position of the bypass valve spool 32 reaches a second movement stroke S2 (S2>S1) larger than the first movement stroke S1. In the illustrated embodiment, the opening area A of the bypass valve 30 is constant at A2 until the bypass valve spool 32 is slightly moved from the initial position and reaches S0, which is a movement stroke smaller than the first movement stroke S1. By thus making the opening area A of the bypass valve 30 constant in a region near the initial position of the bypass valve spool 32, the opening area A of the bypass valve 30 can be set at the second opening area A2 in a state where the current is not applied to the proportional solenoid 36, even when the urging force of the bypass valve spring 34 is slightly smaller than a design value, that is, the accuracy of the opening area A of the bypass valve 30 will be increased. Then, in a range until the movement stroke S reaches the first movement stroke S1 from S0, the opening area A continuously decreases down to 0 (fully closed) from the second opening area A2 as the movement stroke S increases. Next, in a range until the movement stroke S reaches S1' slightly larger than the first movement stroke S1 from the first movement stroke S1, the opening area A is constant at 0 (fully closed). Then, in a range until the movement stroke S reaches the second movement stroke S2 from S1', the opening area A continuously increases from 0 (fully closed) to the first opening area A1, as the movement stroke S increases. Further, in the illustrated embodiment, when the movement stroke S reaches a third movement stroke S3 (S3>S2), which is larger than the second movement stroke S2, the opening area A of the bypass valve 30 is set at a third opening area A3 (A3>A1) larger than the first opening area A1. Further, in a range until the movement stroke S reaches the third movement stroke S3 from the second movement stroke S2, the opening area A continuously increases to the third opening area A3 from the first opening area A1, as the movement stroke S increases.

The hydraulic control circuit 2 will be discussed with reference to FIG. 1. The hydraulic control circuit 2 includes a pilot oil passage 38 that branches from the pump oil passage 16 and extends to each of the pilot ports 10*d* of the hydraulic pilot type control valve 10. That is, in the hydraulic control circuit 2, the hydraulic oil is supplied from the hydraulic pump 6 in common with the pump oil passage 16 and the pilot oil passage 38. In the pilot oil passage 38, a pressure reducing valve 40 that reduces the pressure of the hydraulic oil discharged from the hydraulic pump 6 to generate a pilot primary pressure, a check valve 42 for retaining the pilot primary pressure, an accumulator 44 for smoothing the pilot primary pressure, and a plurality of electromagnetic proportional pressure reducing valves 46 that control the pressure (pilot secondary pressure) acting on the pilot port 10*d* of the hydraulic pilot type control valve 10 are arranged in this order from the upstream side. Since the opening area of the electromagnetic proportional pressure reducing valve 46 is 0 (fully closed) in a state where no current is being applied to the electromagnetic proportional pressure reducing valve 46, the control valve spool 12 of the hydraulic pilot type control valve 10 is positioned at the neutral position by the control valve spring 14. When an electric current is applied to the solenoid proportional pressure reducing valve 46, the electromagnetic proportional pressure reducing valve 46 is opened, and the opening area of the electromagnetic proportional pressure reducing valve 46 increases as the current applied to the electromagnetic proportional pressure reducing valve 46 increases. As the opening area of the solenoid proportional pressure reducing valve 46 increases, the pilot secondary pressure on the downstream side of the opened electromagnetic proportional pressure reducing valve 46 increases, and the control valve spool 12 is designed to move from the neutral position by the pilot secondary pressure. Further, in the illustrated embodiment, there is provided an additional oil passage 48 that branches from between the check valve 42 and the electromagnetic proportional pressure reducing valve 46 in the pilot oil passage 38, and extends to the hydraulic oil tank 20 passing through the other end side of the bypass valve spool 32 (the side on which the proportional solenoid 36 is disposed), so that the pilot primary pressure acts on the other end side of the bypass valve spool 32. Only a pair of electromagnetic proportional pressure reducing valves 46 are illustrated in FIG. 1, for the sake of convenience, but the electromagnetic proportional pressure reducing valve 46 is connected to the pilot port 10*d* of each hydraulic pilot type control valve 10, that is, each pair of solenoid proportional pressure reducing valves 46 are provided for one hydraulic pilot type control valve 10.

As illustrated in FIG. 1, the hydraulic control circuit 2 includes a controller 50 that controls the operation of the bypass valve 30 and the electromagnetic proportional pressure reducing valves 46, and an operation implement 52 that outputs an operation signal to the controller 50 according to an operation applied from an operator. The operation implement 52 may be constituted of an operating lever to which manual operation is applied from the operator or an operating pedal to which a treading operation is applied from the operator. The operation implement 52 is electrically connected to the controller 50, and outputs an operation signal formed of an electrical signal to the controller 50 according to the amount and direction of the operation applied from the operator. The controller 50 is electrically connected to each of the electromagnetic proportional pressure reducing valves 46, and controls the current applied to each of the electromagnetic proportional pressure reducing valves 46 in accordance with to the operation signal which is output from the operation implement 52. That is, the controller 50 does not apply electric current to each of the electromagnetic proportional pressure reducing valves 46 in a state where the operation signal is not output from the operation implement 52, changes electric current to be applied to the electromagnetic proportional pressure reducing valves 46 corresponding to an operation applied to the operation implement 52, in accordance with to the change in the operation signal of the operation implement 52 based on the increase in the amount of the operation applied to the operation implement 52 to increase the opening area of the electromagnetic proportional pressure reducing valve 46. In addition, the controller 50 is also electrically connected to the proportional solenoid 36 of the bypass valve 30. The operation control of the bypass valve 30 by the controller 50 will be discussed below. Further, the controller 50 is also electrically connected to the pressure sensor 26, and a value of the pressure of the pump oil passage 16 detected by the pressure sensor 26 is input to the controller 50 from the pressure sensor 26.

The operation of the hydraulic control circuit 2 configured as described above will be discussed. First, the operation of the hydraulic control circuit 2 in a state after the engine 4 is started and the pressure of the pump oil passage 16 reaches a required pressure P0 will be discussed. In a state where no operation signal is output to the controller 50 from the operation implement 52, after the engine 4 has been started and the pressure of the pump oil passage 16 has reached the required pressure P0 (i.e., when the operation implement 52 is put in neutral, with no operation being applied to the operation implement 52), the controller 50 applies electric current to the proportional solenoid 36 of the bypass valve 30 so that the movement stroke S from the initial position of the bypass valve spool 32 reaches the second movement stroke S2, to set the opening area A of the bypass valve 30 at the first opening area A1. The size of the first opening area A1 is a size that allows the pressure of the pump oil passage 16 to be maintained at a level of the required pressure P0, in a state where the rotational speed of the engine 4 is a level of a predetermined rotational speed (e.g., a rated rotational speed), and the discharge amount of the hydraulic pump 6 is a level of a predetermined amount. The required pressure P0 is, for example, about 4 MPa, which is a value larger than the pilot primary pressure. The pilot primary pressure is a value larger than a maximum value of a pilot secondary pressure for operating the control valve spool 12 against the urging force of the control valve spring 14. On the other hand, increasing the pressure of the pump oil passage 16 when the operation implement is put in neutral leads to an increase in fuel consumption that is not used for the work of the construction machine, and therefore it is suitable that the required pressure P0 is as small as possible from the viewpoint of energy saving. When the operation implement is in neutral, the controller 50 does not apply electric current to each of the electromagnetic proportional pressure reducing valves 46, and therefore the opening area of each of the electromagnetic proportional pressure reducing valves 46 is 0 (fully closed), and each of the control valve spools 12 is positioned at the neutral position by the control valve spring 14. If the state where the operation signal is not output from the operation implement 52 to the controller 50 continues for a predetermined time, the controller 50 applies electric current to the proportional solenoid 36 of the bypass valve 30 so that the movement stroke S reaches a third movement stroke S3, to set the opening area A of the bypass valve 30 at a third opening area A3. Consequently, the pressure loss of the bypass oil passage 28 is reduced, and thus energy saving can be achieved when the operation implement is put in neutral.

When an operation is applied to the operation implement 52 and an operation signal is output from the operation implement 52, after the engine 4 has been started and the pressure of the pump oil passage 16 has reached the required pressure P0, the controller 50 applies electric current to the electromagnetic proportional pressure reducing valve 46 corresponding to the operation applied to the operation implement 52 and opens the electromagnetic proportional pressure reducing valve 46 depending on the operation signal output from the operation implement 52. Then, the pilot secondary pressure acts on the pilot port 10*d* of the hydraulic pilot type control valve 10 corresponding to the operation applied to the operation implement 52, and thereby the control valve spool 12 moves. In addition, the controller 50 changes on directly proportional basis electric current to be applied to the proportional solenoid 36 of the bypass valve 30, in accordance with the operation signal output from the operation implement 52. That is, as the amount of operation applied to the operation implement 52 increases from 0 (when the operation implement is put in neutral) to the maximum, the controller 50 decreases on directly proportional basis the movement stroke S from the initial position of the bypass valve spool 32 from the second movement stroke S2 to the first movement stroke S1 or S1', and decreases on directly proportional basis the opening area A of the bypass valve 30 down to 0 (fully closed) from the first opening area A1. Therefore, the amount of the hydraulic oil returning to the hydraulic oil tank 20 passing through the bypass oil passage 28 decreases, depending on the amount of the operation applied to the operation implement 52, and the hydraulic oil discharged from the hydraulic pump 6 is supplied to the hydraulic actuator 8 passing through the pump oil passage 16, the hydraulic pilot type control valve 10 and an actuator oil passage 22, and thereby the hydraulic actuator 8 is operated.

As described above, in the hydraulic control circuit 2, when the operation implement is put in neutral, in a state after the engine 4 has been started and the pressure of the pump oil passage 16 has reached the required pressure P0, the controller 50 sets the opening area A of the bypass valve 30 at the opening area A1. Accordingly, the pressure of the pump oil passage 16 is maintained at a level of the required pressure P0 which is larger than the pilot primary pressure for generating the pilot secondary pressure, so that the pilot secondary pressure immediately acts on the control valve spool 12 when the operation of the operation implement 52 is applied, to allow an amount and a direction of the supply of the hydraulic oil supplied to the hydraulic actuator 8 to be controlled. Thus, the operational responsiveness of the hydraulic actuator 8 to the operation applied to the operation implement 52 is preferable. In the illustrated embodiment, pilot oil is guided to the other end side of the bypass valve spool 32 by providing an additional oil passage 48, and the proportional solenoid 36 and the pilot primary pressure acts on the other end side of the bypass valve spool 32. For this reason, the opening area of the bypass valve 30 becomes larger than the second opening area A2 when the operation implement is put in neutral. Correspondingly with this, if the pressure of the pump oil passage 16 becomes smaller than the required pressure P0, and the pilot primary pressure becomes smaller than the predetermined pressure, then the movement stroke S of the bypass valve spool 32 will become smaller than the second movement stroke S2, and accordingly the opening area A of the bypass valve 30 will become smaller. Thus, the pressure of the pump oil passage 16 is adjusted so as to attain the required pressure P0.

Next, the operation of the hydraulic control circuit 2 when the engine 4 is started will be discussed. Because no electric current is applied from the controller 50 to the proportional solenoid 36 of the bypass valve 30 before the engine 4 is started, the bypass valve spool 32 is positioned at the initial position by the bypass valve spring 34, and thus the opening area A of the bypass valve 30 is set at the second opening area A2. In addition, the opening area of each electromagnetic proportional pressure reducing valve 46 is 0 (fully closed), because no current is also applied from the controller 50 to each of the electromagnetic proportional pressure reducing valves 46, and therefore the control valve spool 12 of each of the hydraulic pilot type control valves 10 is positioned at the neutral position by the control valve spring 14. When the engine 4 is started in this manner, the pump oil passage 16 is closed by the hydraulic pilot type control valve 10, and the pilot oil passage 38 is closed by each of the electromagnetic proportional pressure reducing valves 46. However, the opening area A of the bypass valve 30 is set at the second opening area A2, that is, the bypass oil passage 28 is not closed by the bypass valve 30. This configuration prevents a sudden rise in the pressure of the pump oil passage 16 immediately after the engine 4 is started and the hydraulic pump 6 is driven by the engine 4, and prevents a rapid increase in the load of the engine 4 due to the sudden increase in the pressure of the pump oil passage 16. In addition, during a time duration from the start of the engine 4 until the pressure of the pump oil passage 16 reaches the required pressure P0, the controller 50 does not apply electric current to the proportional solenoid 36 of the bypass valve 30 and each of the electromagnetic proportional pressure reducing valves 46 as well, sets the opening area A of the bypass valve 30 at the second opening area A2 smaller than the first opening area A1 and closes the electromagnetic proportional pressure reducing valves 46, similarly to before the engine 4 is started. In this manner, during a time duration d from the start of the engine 4 until the pressure of the pump oil passage 16 reaches the required pressure P0, the opening area A of the bypass valve 30 is set at the second opening area A2 smaller than the first opening area A1 when the operation implement is put in neutral. Thus, the time from the start of the engine 4 until the pressure of the pump oil passage 16 reaches the required pressure P0 can be shortened. In other words, the opening area A of the bypass valve 30 immediately after the start of the engine 4, in which the rotational speed of the engine 4 is smaller than the predetermined rotational speed and the discharge amount of the hydraulic pump 6 is also less than the predetermined discharge amount, is set at the second opening area A2 smaller than the first opening area A1, equivalent to a size which allows the pressure of the pump oil passage 16 to be maintained at a level of the required pressure P0 in a state where the rotational speed of the engine 4 is a level of the predetermined rotation speed and the discharge amount of the hydraulic pump 6 is a level of the predetermined amount. As a result, compared to the prior art in which the opening area of the bypass valve 30 when the operation implement is put in neutral and the opening area of the bypass valve 30 immediately after the engine 4 is started are equal, the time from the start of the engine 4 until the pressure of the pump oil passage 16 reaches the required pressure can be shortened. Thus, an improved operational responsiveness of the hydraulic actuator to the operation applied to the operation implement is achieved.

In the illustrated embodiment, if the operation of the bypass valve 30 is disabled by reason that an electric wire connecting the controller 50 and the proportional solenoid 36 of the bypass valve 30 is cut, for example, then the bypass valve spool 32 is positioned at the initial position by the bypass valve spring 34, and the opening area A of the bypass valve 30 reaches the second opening area A2. Even in the above-mentioned case, the pressure of the pump oil passage 16 rises to a degree enough to secure the pilot secondary pressure enough to cause the bypass valve spool 32 to move, and thus, the construction machine can be operated to some extent even in the above-mentioned case.

Regarding a configuration in which the controller 50 detects that the engine 4 is started, it can be configured in such a manner that a switch (not illustrated) of the engine 4 and the controller 50 are electrically connected to each other, an operation applied to the switch for starting or stopping the engine 4 is input into the controller 50, whereby allowing the controller 50 to detect that the engine 4 has been started. Alternatively, it may be configured in such a manner as to provide a rotational speed detector (not illustrated) for detecting a rotational speed of the engine 4, to electrically connect the rotational speed detector and the controller 50, and to input the rotational speed of the engine 4 into the controller 50, whereby allowing the controller 50 to detect that the engine 4 has been started.

Figure 3:
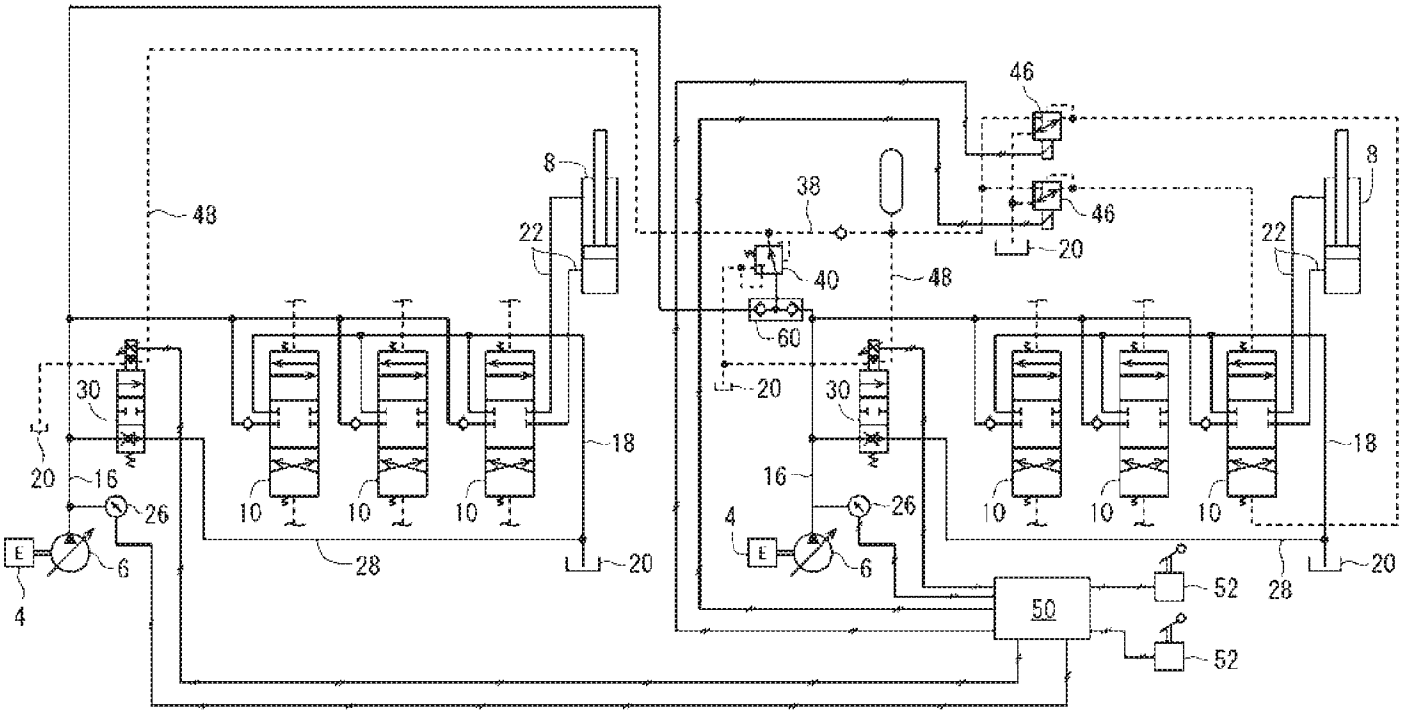
FIG. 3 is a circuit diagram in a case where a plurality of hydraulic pumps are provided.

In the illustrated embodiment, an example has been described, in which the hydraulic oil is supplied to the pump oil passage 16 and the pilot oil passage 38 from the single hydraulic pump 6. As illustrated in FIG. 3, however, it may be configured in such a manner as to provide a shuttle valve 60 in a portion on the upstream side of the pressure reducing valve 40 in the pilot oil passage 38, and supply the hydraulic oil to the pilot oil passage 38 from any one of the plurality of hydraulic pumps 6. In the example illustrated in FIG. 3, there are provided a plurality of bypass oil passages 28 that branch from each of the pump oil passages 16 of the plurality of hydraulic pumps 6 and extend to the hydraulic oil tanks 20, and the bypass valves 30 disposed in the respective bypass oil passages 28.

REFERENCE SIGNS LIST

2 hydraulic control circuit
4 engine
6 hydraulic pump
8 hydraulic actuator
10 hydraulic pilot type control valve
10*a* pump port
10*b* tank port
10*c* actuator port
10*d* pilot port
16 pump oil passage
20 hydraulic oil tank
28 bypass oil passage
30 bypass valve
32 bypass valve spool
34 bypass valve spring
36 proportional solenoid
38 pilot oil passage
46 electromagnetic proportional pressure reducing valve
50 controller
52 operation implement
A opening area of bypass valve
A1 first opening area
A2 second opening area
S1 first movement stroke
S2 second movement stroke

The invention claimed is:

1. A hydraulic control circuit for a construction machine, the hydraulic control circuit comprising:

a hydraulic pump that is driven by an engine;

a hydraulic actuator that is operated by hydraulic oil discharged from the hydraulic pump;

a hydraulic pilot type control valve that controls an amount and a direction of supply of the hydraulic oil from the hydraulic pump to the hydraulic actuator;

a pump oil passage that connects the hydraulic pump and a pump port of the hydraulic pilot type control valve;

a bypass oil passage that branches from, the pump oil passage and extends to a hydraulic oil tank;

a bypass valve that is disposed in the bypass oil passage and controls an amount of the hydraulic oil returning to the hydraulic oil tank through the bypass oil passage;

a pilot oil passage that branches from the pump oil passage and extends to a pilot port of the hydraulic pilot type control valve;

an electromagnetic proportional pressure reducing valve that is disposed in the pilot oil passage and controls a pressure acting on the pilot port;

a controller that controls an operation of the bypass valve and the electromagnetic proportional pressure reducing valve; and an operation implement for outputting au operation signal to the controller in response to an operation applied from an operator, wherein the controller sets the opening area of the bypass valve to a first opening area in a state where an operation signal is not output from the operation implement after the engine has been started and the pressure of the pump oil passage has reached a required pressure, and sets the opening area of the bypass valve to a second opening area which is smaller than the first opening area during a time duration from the start of the engine until the pressure of the pump oil passage reaches the required pressure.

2. The hydraulic control circuit for the construction machine according to claim 1, wherein the bypass valve includes a bypass valve housing, a bypass valve spool movably housed in the bypass valve housing, a bypass valve spring that urges the bypass valve spool to an initial position, and a proportional solenoid that causes the bypass valve spool to move against an urging force of the bypass valve spring, wherein, the opening area of the bypass valve is set at the second opening area when the bypass valve spool is positioned at the initial position, the opening area of the bypass valve is set at 0 when a movement stroke from the initial position of the bypass valve spool reaches a first movement stroke, and the opening area of the bypass valve is set at the first opening area when a movement stroke from the initial position of the bypass valve spool reaches a second movement stroke which is larger than the first movement stroke.

* * * * *